US010603557B1

(12) United States Patent
Bergstrom

(10) Patent No.: US 10,603,557 B1
(45) Date of Patent: Mar. 31, 2020

(54) HOCKEY STICK BLADE

(71) Applicant: John A. Bergstrom, Dassel, MN (US)

(72) Inventor: John A. Bergstrom, Dassel, MN (US)

(73) Assignee: John A. Bergstrom, Dassel, MN (US)

( * ) Notice: Subject to any disclaimer, the term of this patent is extended or adjusted under 35 U.S.C. 154(b) by 0 days.

(21) Appl. No.: 16/252,880

(22) Filed: Jan. 21, 2019

(51) Int. Cl.
*A63B 59/70* (2015.01)
*A63B 102/24* (2015.01)
*A63B 102/22* (2015.01)

(52) U.S. Cl.
CPC ..... *A63B 59/70* (2015.10); *A63B 2102/22* (2015.10); *A63B 2102/24* (2015.10)

(58) Field of Classification Search
CPC . A63B 2102/24; A63B 59/50; A63B 2102/22; A63B 59/70
USPC ..... 473/560–563
See application file for complete search history.

(56) References Cited

U.S. PATENT DOCUMENTS 676,736 A 6/1901 Dean
682,807 A 9/1901 Minor
1,674,173 A 6/1928 Haupt
2,489,958 A 11/1949 Douglass
3,350,249 A 10/1967 Gregoire
3,561,760 A * 2/1971 Klay ..... A63B 53/10 473/563
3,563,546 A 2/1971 Dawe
3,844,555 A * 10/1974 Tremblay ..... A63B 59/00 473/563
D244,219 S 5/1977 Poirier
4,076,240 A 2/1978 Haddad
4,172,594 A 10/1979 Diederich
4,343,468 A 8/1982 Lindgren
4,353,549 A 10/1982 Goupil et al.
4,452,451 A 6/1984 Dubreuil
4,512,573 A 4/1985 Coolen
4,570,932 A 2/1986 Cote
4,664,379 A 5/1987 Melby
4,793,613 A 12/1988 Hughes
4,799,682 A 1/1989 Hughes
5,078,396 A 1/1992 Cavallaro et al.
D344,559 S 2/1994 Ilacqua
D360,443 S 7/1995 Berghash
5,582,405 A 12/1996 Montgomery
D380,243 S 6/1997 Neufeld
6,019,691 A * 2/2000 Hilborn ..... A63B 59/70 473/563
6,471,609 B1 10/2002 Fell
7,294,072 B2 11/2007 Montecchia
(Continued)

*Primary Examiner* — Jeffrey S Vanderveen
(74) *Attorney, Agent, or Firm* — Steven M. Koehler; Westman, Champlin & Koehler, P.A.

(57) ABSTRACT

A hockey stick blade includes a blade member extending in a longitudinal direction from a heel end to a toe end. The blade includes forehand and backhand puck-engaging surfaces extended between said ends. An extension is joined to or formed with the toe end of the blade member and extends away from the toe end of the blade member in a backhand direction. The extension and a portion of the blade member at the toe end joined to the extension form a L-shaped structure, preferably, wherein a thickness of the extension at an extension center portion, approximately half way toward a remote end of the extension, is less than or about equal to a thickness of a center portion of the blade member between the heel end and the toe end.

19 Claims, 11 Drawing Sheets

(56) References Cited

U.S. PATENT DOCUMENTS

| | | | | |
|---|---|---|---|---|
| 8,231,486 | B2 | 7/2012 | Neufeld | |
| 2001/0046909 | A1* | 11/2001 | Pagotto | A63B 59/70 473/563 |
| 2005/0070382 | A1* | 3/2005 | Loschiavo | A63B 69/0026 473/563 |
| 2007/0281809 | A1* | 12/2007 | Garcia | A63B 59/70 473/560 |
| 2012/0058843 | A1* | 3/2012 | Neufeld | A63B 59/70 473/563 |
| 2012/0083370 | A1* | 4/2012 | Girsky | A63B 60/00 473/563 |
| 2014/0094329 | A1* | 4/2014 | Taylor | A63B 69/0026 473/563 |

* cited by examiner

HOCKEY STICK BLADE

BACKGROUND

The discussion below is merely provided for general background information and is not intended to be used as an aid in determining the scope of the claimed subject matter.

Various forms of hockey stick blades have been advanced throughout the years in an effort to improve puck handling by a hockey player. Many years ago, the hockey stick blade having a concave surface for the forehand shot was adopted. This has generally improved the ability of the hockey player to control the puck, for instance, allowing the player to skate around other players with the puck and improving the accuracy of shooting and passing. However, with the forehand surface having a concave shape due to bending of the blade, a rearward facing surface, or backhand surface, becomes convex, thereby rendering it less able to effectively be used by the hockey player for puck handling.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

An aspect of the invention is a hockey stick blade having a blade member extending in a longitudinal direction from a heel end to a toe end. The blade includes forehand and backhand puck-engaging surfaces extending between the ends. An extension is joined to or formed with the toe end and extends away from the toe end of the blade member in a backhand direction. The extension and a portion of the blade member at the toe end joined to the extension form a L-shaped structure, preferably, wherein a thickness of the extension at an extension center portion, approximately halfway toward a remote end of the extension, is less than or about equal to a thickness of a center portion of the blade member between the heel end and the toe end.

DETAILED DESCRIPTION OF ILLUSTRATIVE EMBODIMENTS

Figure 1:
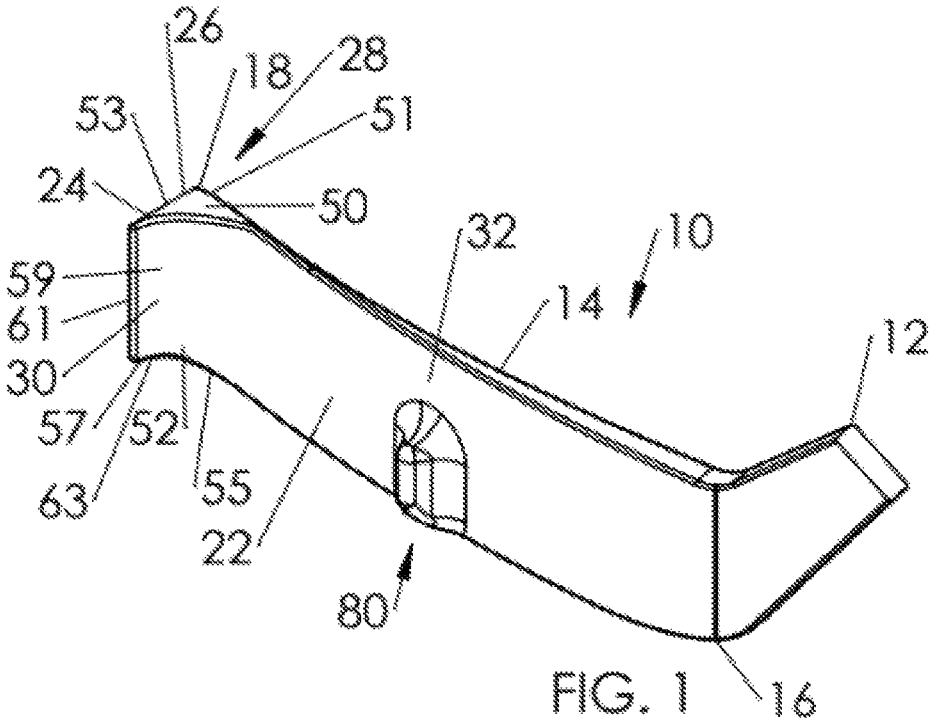
FIG. 1 is a perspective view of a hockey stick blade.
Figure 2:
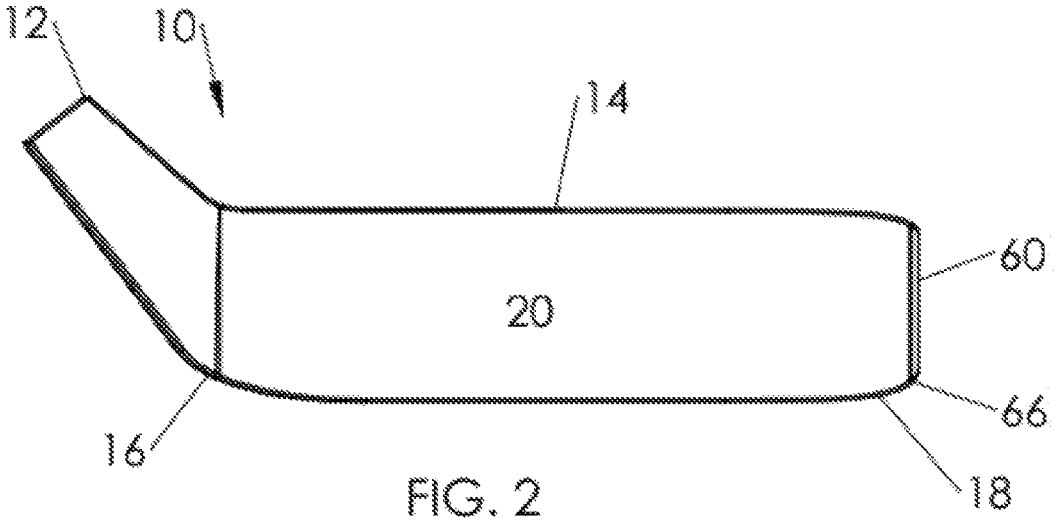
FIG. 2 is a front elevational view of the hockey stick blade.
Figure 3:
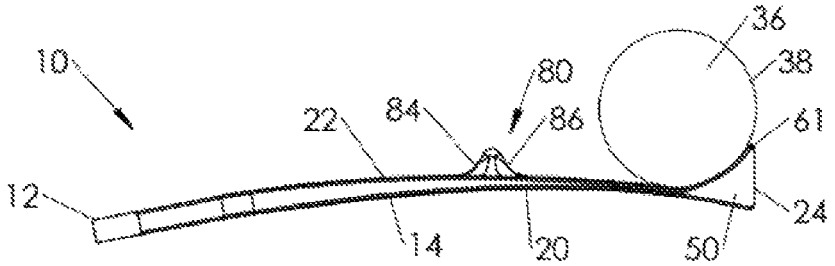
FIG. 3 is a top plan view of the hockey stick blade.
Figure 4:
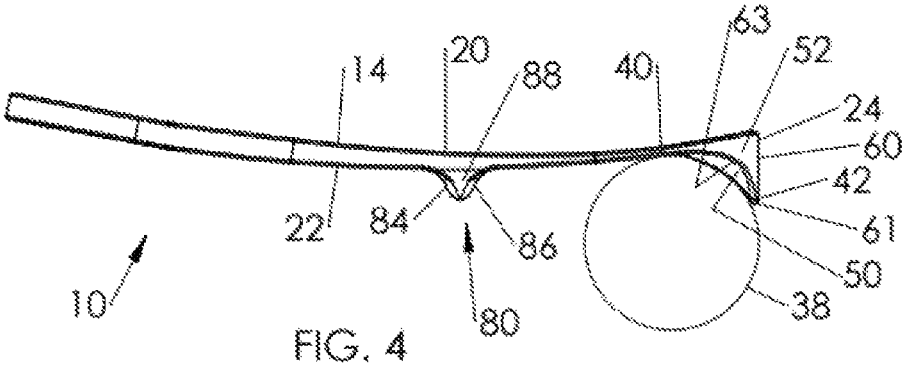
FIG. 4 is a bottom plan view of the hockey stick blade.

Four embodiments of hockey stick blades are illustrated in the figures. FIGS. 1-5 and 11-20 illustrate embodiments of hockey stick blades 10, 10", 10''' that may be preferable for use by a non-goalie hockey player, while FIGS. 6-10 illustrate an embodiment of a hockey stick blade 10' that may be preferable for use by a goalie. The hockey stick blades 10, 10', 10", 10''' have many common features as described below wherein a difference of the hockey stick blades 10' is that the hockey stick blade 10' used by a goalie is generally longer from a toe end to a heel end and has a wider blade surface. Like reference numbers have been used in FIGS. 1-20 to identify the same or similar elements found in the hockey stick blades 10, 10', 10", 10'''.

Referring now to FIGS. 1-5, the hockey stick blade 10 is shown in its entirety while a handle 12 is only partly illustrated since aspects of the handle are not pertinent to the present invention. However, it should be understood that the hockey stick blade 10 can be formed integral from a single unitary body with the handle 12, or a lower portion thereof. If desired, the hockey stick blade 10 can also be a separate unit that is attached to a lower end of the handle 12, being made of the same material as the handle 12, or being made of a different material. Commonly, the hockey stick blade 10 can be made from any suitable material including but not limited to plastic, wood, fiberglass, metal, or combinations thereof.

The hockey stick blade 10 includes a blade member 14 extending in a longitudinal direction from a heel end 16, where the handle 12 is located or joined thereto, to a toe end 18. The blade member 14 has a forehand puck-engaging surface 20 and a backhand puck-engaging surface 22 extending between the ends 16, 18. An extension 24 is joined to or formed integrally therewith from a single unitary body with the toe end 18 and extends away from the toe end 18 in a backhand direction away from the forehand puck-engaging surface 20. The extension 24 and an end portion 26 of the blade member 14 at the toe end 18 form an "L-shaped" structure 28. Preferably, a thickness of the extension 24 at an extension center portion 30 is less than or about equal to a thickness of a center portion 32 of the blade member 14, wherein the thickness of the center portion 32 is measured between the forehand and backhand puck-engaging surfaces 20, 22 where each corresponding surface portion is planer and generally parallel to each other. In other words, the thickness of the center portion 32 of the blade member 14 that is compared to the thickness of the extension 24 does not include any protrusion that may be present on the backhand puck-engaging surface 22 between the ends 16, 18.

Particularly for a non-goalie hockey player, the forehand puck-engaging surface 20 of the blade member 14 is concave with respect to ends 16, 18, while the backhand puck-engaging surface 22 is generally convex between the ends 16, 18 for a major portion thereof. The convex nature of the backhand puck-engaging surface 22 is generally an awkward surface for use by the hockey player since a puck in contact with the backhand puck-engaging surface 22 has a tendency to move toward either of the ends 16, 18, particularly with motion of the blade member 14 in the backhand direction.

Figure 5:
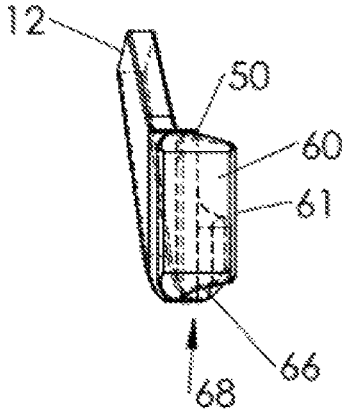
FIG. 5 is a side elevational view of a toe end of the hockey stick blade.
Figure 6:
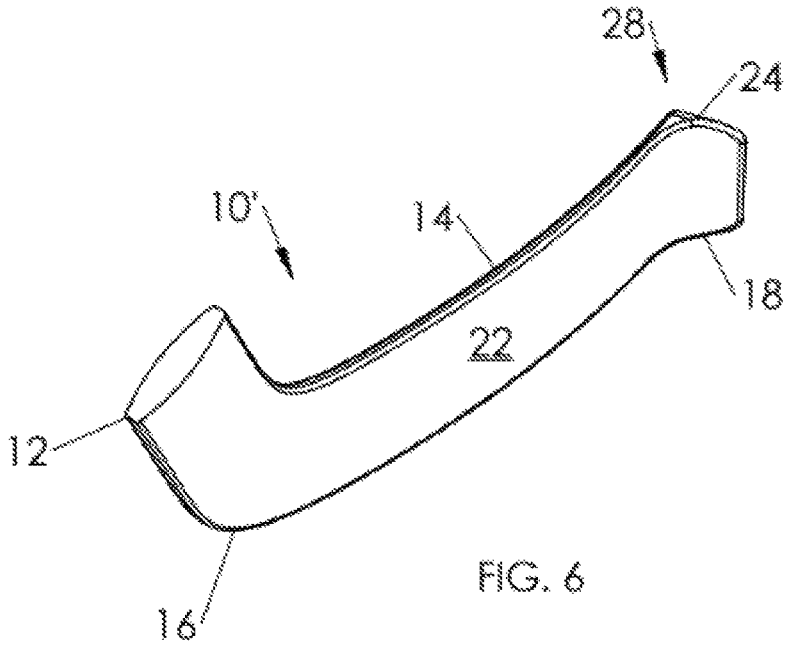
FIG. 6 is a perspective view of a second embodiment of a hockey stick blade.
Figure 7:
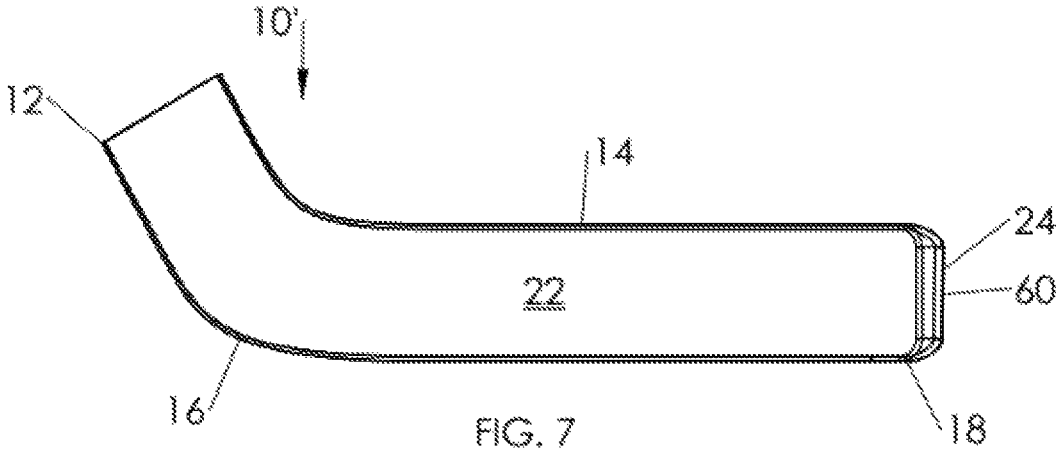
FIG. 7 is a front elevational view of the hockey stick blade of FIG. 6.
Figure 8:
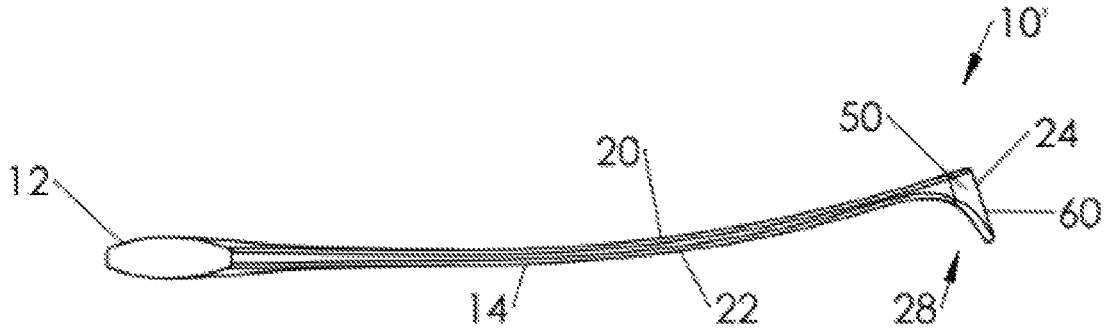
FIG. 8 is a top plan view of the hockey stick blade of FIG. 6.
Figure 9:
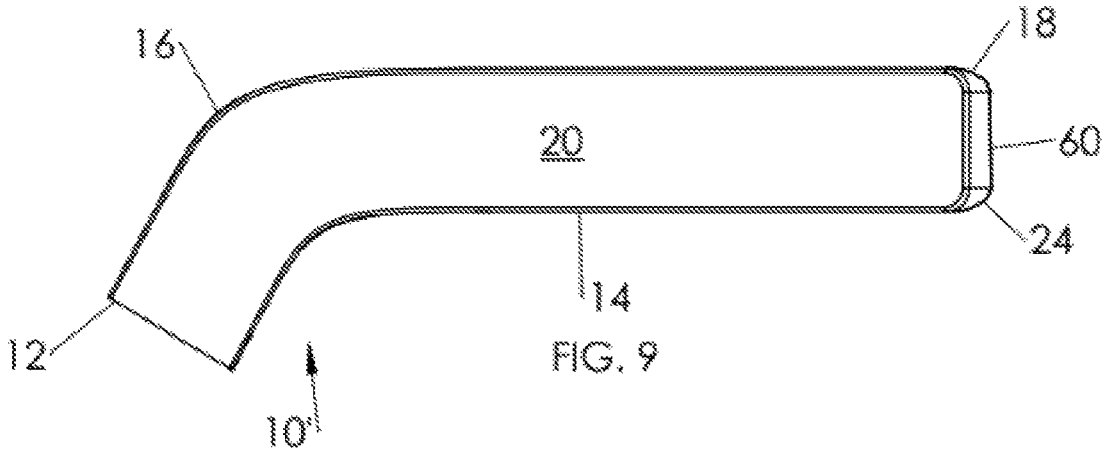
FIG. 9 is a rear elevational view of the hockey stick blade of FIG. 6.
Figure 10:
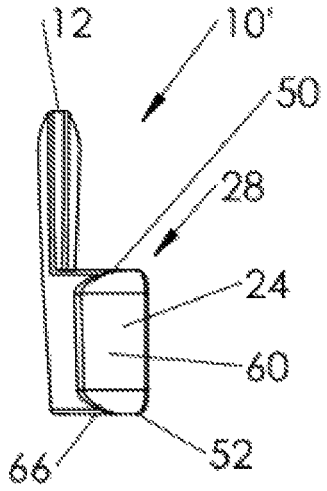
FIG. 10 is a side elevational view of a toe end of the hockey stick blade of FIG. 6.
Figure 11:
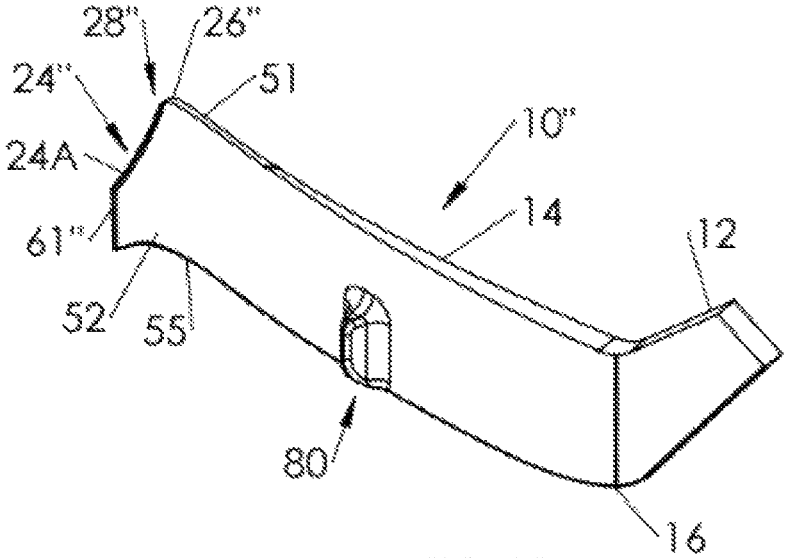
FIG. 11 is a perspective view of a third embodiment of a hockey stick blade.
Figure 12:
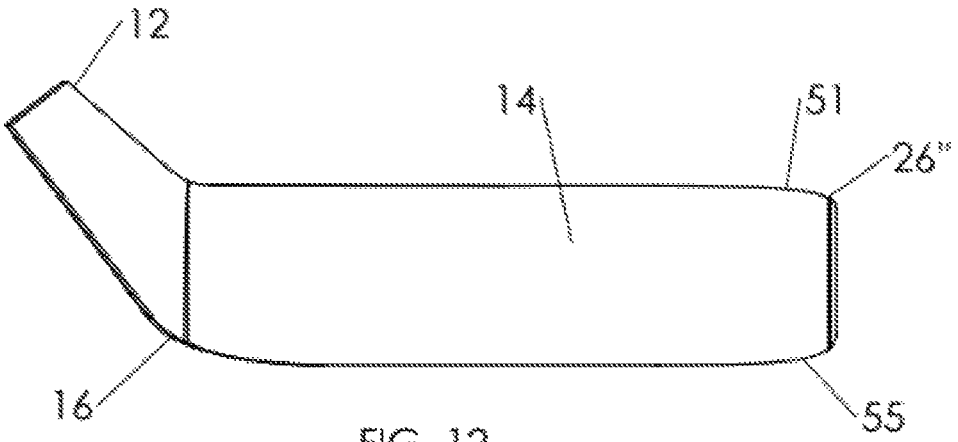
FIG. 12 is a front elevational view of the hockey stick blade of FIG. 11.
Figure 13:
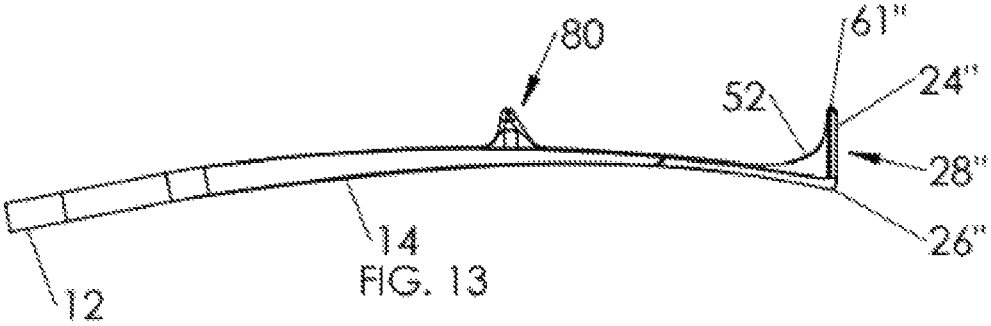
FIG. 13 is a top plan view of the hockey stick blade of FIG. 11.
Figure 14:
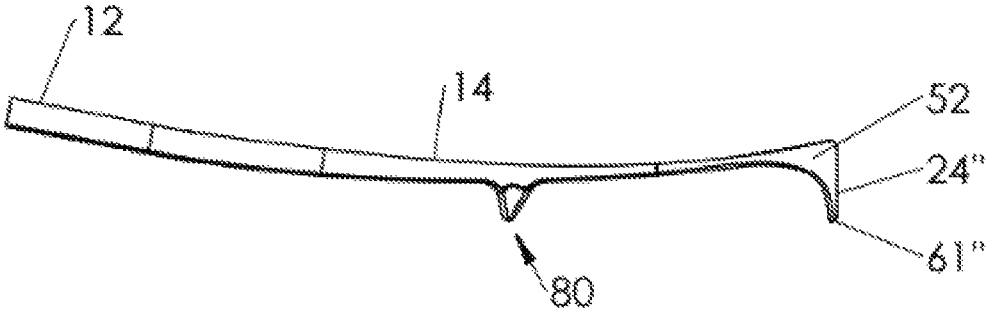
FIG. 14 is a bottom plan view of the hockey stick blade of FIG. 11.
Figure 15:
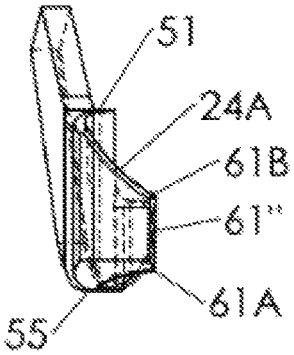
FIG. 15 is a side elevational view of a toe end of the hockey stick blade of FIG. 11.
Figure 16:
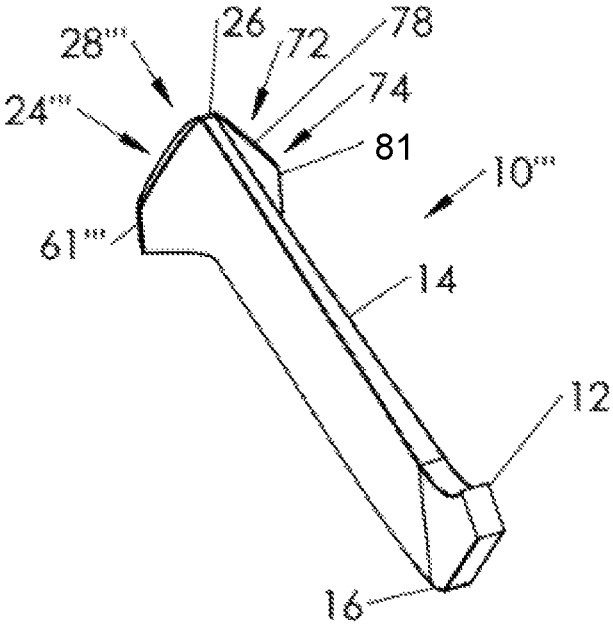
FIG. 16 is a perspective view of a third embodiment of a hockey stick blade.
Figure 17:
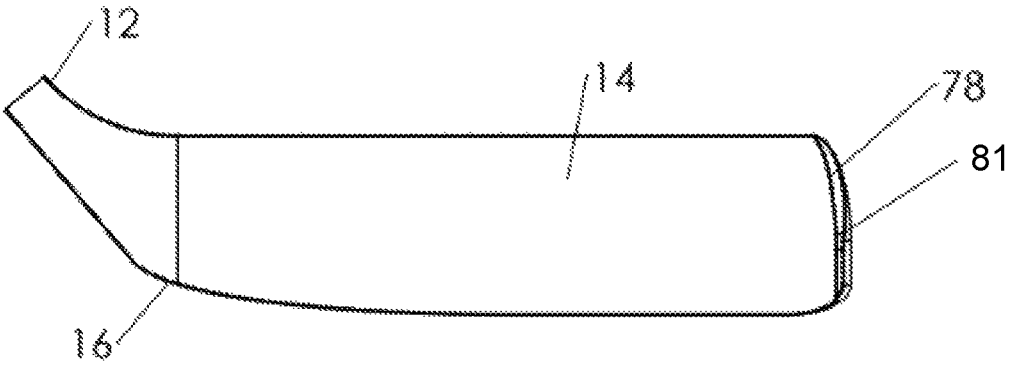
FIG. 17 is a front elevational view of the hockey stick blade of FIG. 16.
Figure 18:
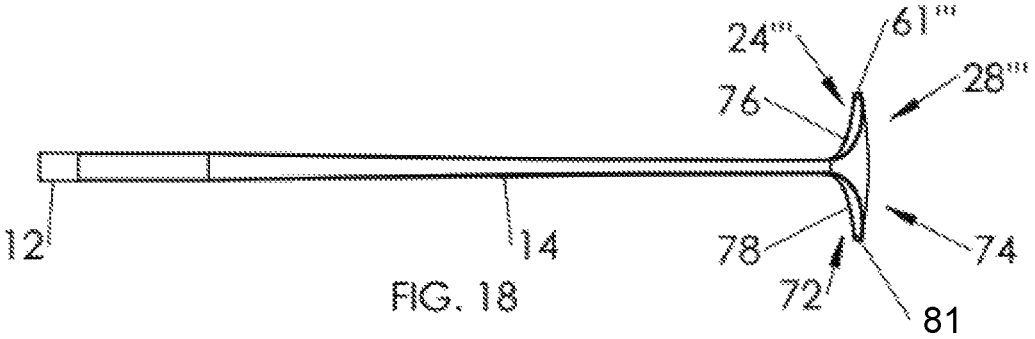
FIG. 18 is a top plan view of the hockey stick blade of FIG. 16.
Figure 19:
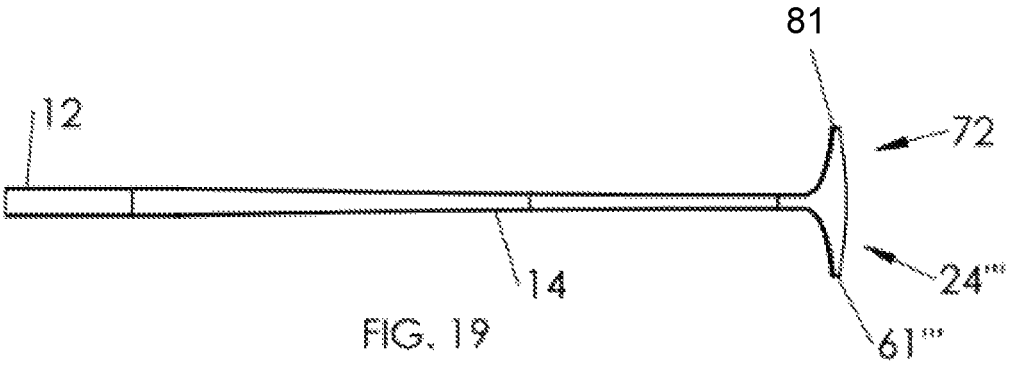
FIG. 19 is a bottom plan view of the hockey stick blade of FIG. 16.
Figure 20:
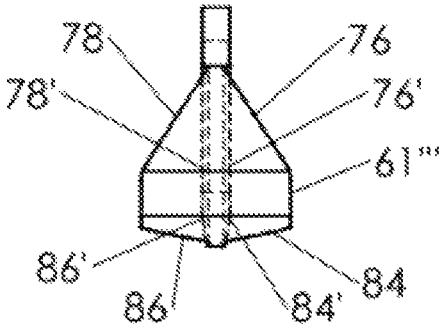
FIG. 20 is a side elevational view of a toe end of the hockey stick blade of FIG. 16.
Figure 21:
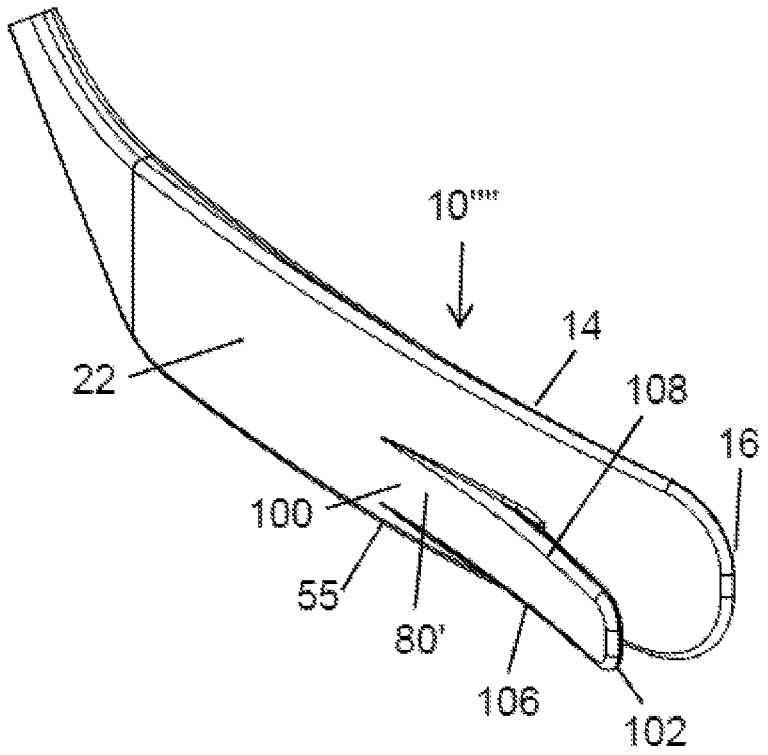
FIG. 21 is a perspective view of a fourth embodiment of a hockey stick blade.
Figure 22:
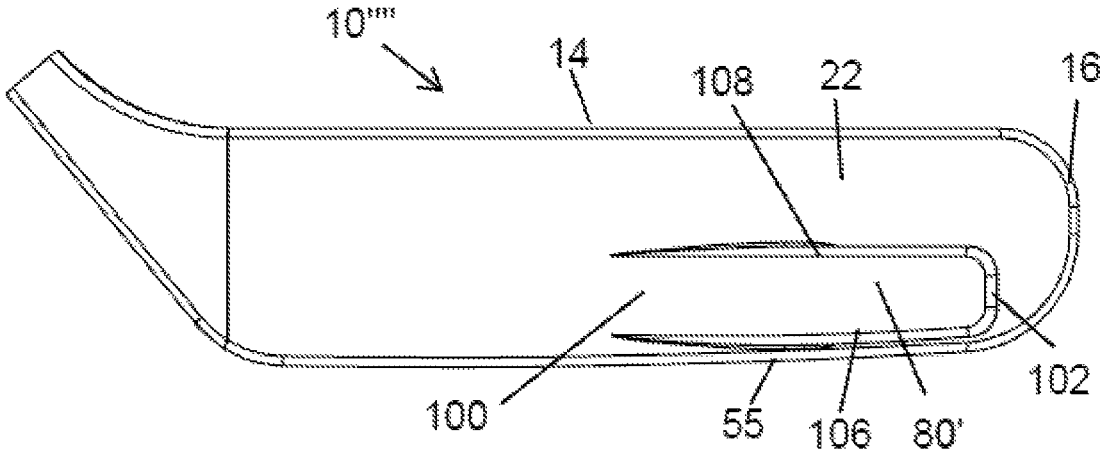
FIG. 22 is a rear elevational view of the hockey stick blade of FIG. 21.

The "L-shaped" structure 28 on the toe end 18 of the blade member 14 inhibits a puck 36 (illustrated in FIGS. 3 and 4) from rolling off the toe end 18. In a preferred embodiment as illustrated in FIG. 5, the "L-shaped" structure 28 is configured such that the cylindrical perimeter surface 38 of the puck 36 contacts the blade member 14 at two spaced apart locations, a first location being at 40 on the backhand puck-engaging surface 22 and a second location at 42 with the extension 24, preferably at a remote or end portion of the extension 24. Stated another way, the L-shaped structure 28 is configured such that an inner corner 63 formed between the extension 24 and the end 26 portion of the blade member 14 at the toe end 18 that is spaced apart from the peripheral cylindrical outer surface 38 of the puck 36 when the peripheral cylindrical outer surface 38 is in contact (preferably along a vertically oriented line when the puck 36 is flat on the ice) with the extension 24 and the backhand puck-engaging surface 22 at the same time. Since contact is generally along a line at locations 40, 42 on the perimeter cylindrical surface 38 of the puck 36, the hockey stick blade 10 gives the hockey player significant control over the puck 36, thereby giving the player increased ability to control the motion of the puck while in contact with the stick 10 as well as pass or shoot the puck 36 with better accuracy, greater force (resulting in higher puck speed) and/or repeatability.

If desired, the "L-shaped" structure 28 created by the end portion 26 of the toe end 18 and the extension 24 can include reinforcing members or plates joined to the blade member 14 at the toe end 18 and the extension 24. The reinforcing members can be formed integral from a single unitary body with either or both of the blade member 14 and the extension 24. In the embodiment illustrated, the reinforcing member includes an upper member 50 and a lower member 52, although it should be understood that, if desired, only one may be provided. Likewise, the other embodiments described herein may not have any reinforcing members, or located at different positions than that illustrated. In the exemplary embodiment, the upper member 50 is joined to or extends from an upper edge 51 of the blade member 14 proximate the toe end 18, and it is also joined to or extends from an upper edge 53 of the extension 24, herein illustrated as extending along the entire length of the upper edge 53 of the extension 24; however, this should not be considered limiting.

The lower member 52 has a similar construction as that of the upper member 50 where it extends from a lower edge 55 of the blade member 14 proximate the toe end 18 and a lower edge 57 of the extension 24 again herein illustrated as being along the entire length of the extension 24, but that should not be considered limiting.

It should be noted that, if desired, the members 50 and/or 52 can have upwardly or downwardly facing surfaces, respectively, that are slightly curved so as to smoothly blend with the surface 60 of the extension 24 and/or the blade member 14. Also, if desired, inner surfaces of the members 50 and/or 52 can smoothly blend with the backhand puck engaging-surface 22 and the surface 59 of the extension 24 opposite to the surface 60 in also a smooth manner, for example, thereby creating a fillet between these surfaces.

In an advantageous embodiment the upper member 50 and lower member 52, whether when both or only one is provided, is relatively thin since that is generally all that is needed in order to provide stiffness for the "L-shaped" structure 28. In addition, it is also advantageous to configure a remote end 61 of the extension 24, which is also relatively thin, so that it can function as a hook and engage the puck and thereby be used by the hockey player to locate the end 61 behind the puck (as viewed from the player) which helps the player urge the puck toward the player if the hockey stick blade 10 is pulled by the player. In one embodiment, a width (height) of a remote edge of the end 61 extension 24 is less than a width (height) of the blade member 14 at the center portion 32, the width being generally perpendicular to both a longitudinal length of the extension 24 and a direction corresponding to the thickness of the extension 24. In a further preferred embodiment, the width of the extension 24 tapers or decreases in a direction rearwardly from the blade member 14 toward the remote end 61.

In a preferred embodiment, the extension 24 generally extends away from the toe end 18 of the blade member 14 in the backhand direction at an angle formed between the backhand puck-engaging surface 22 and an inwardly facing surface 59 that is less than 90 degrees due to the convex shape of the backhand puck-engaging surface 22. Preferably, this angle is in the range of about 5 to about 50 degrees. Such an angle formed between the extension 24 and the blade member 14 at the toe end 18 enables the outwardly facing surface 60 of the extension 24 that faces in a direction away from the hockey stick player or from the heel end 16 to be substantially parallel to motion of the hockey stick blade 10 when the ends 16 and 18 move at the same rate and in the same direction. The surface 60 is typically flat, which enables the extension 24 or the toe end 18 of the blade member 14 to be placed squarely against the boards of the hockey rink so as to be flush therewith, which is helpful in preventing the puck 36 from getting by the hockey stick blade 10. In addition, when the remote end 61 of the extension 24 is formed so as to function as a hook, then the extension 24 enables the hockey player to hook the hockey puck 36 and pull it off the boards.

It should be noted that the length of the extension 24 is substantially less than the length of the blade member 14 as measured between the ends 16 and 18. Commonly, the length of the extension 24 is less than about two inches. Other lengths of the extension 24 can include being less than about 1.75 inches, or being less than 1.5 inches. The shorter length of the extension reduces the mass of the hockey stick blade while still benefiting from the advantageous shape of the structure 28 to control or grab the puck. The general flatness of the extension 24 on the surface 60 and the generally planer shape thereof also provides a convenient surface for "poke checking" the other player.

Referring to FIG. 5, it should be noted in one embodiment a lower edge 66 of the extension 24 extends upwardly and away from the end portion 26 of the toe end 18 when the blade member 14 is held substantially upright. Stated another way, a relief 68 is formed at a lower end of the extension 24. This enables the blade member 14 to travel in a smooth arc when the hockey player may be shooting or passing without the lower edge 66 of the extension 24 striking the ice. As appreciated by those skilled in the art, sometimes it is desired to strike the puck so as to lift it off the surface of the ice, which is accomplished at least in part by tilting the blade member 14 such that the lower edge 55 leads the upper edge 52 in a manner that the blade member 14 is slightly tilted rearwardly. The lower end 66 of the extension 24 is located above the lower edge 55 of the blade member 14 to enable the blade member 14 to be tilted rearwardly up to a certain angle without the lower edge 66 of the extension 24 contacting the ice.

The hockey stick blade 10 also includes another feature to enable puck control on the backhand puck-engaging surface 22 that being a protrusion herein a cleat 80 extending therefrom. The protrusion 80 can be present on the hockey stick blade 10 with or without the L-shaped structure 28 described above. The protrusion 80 provides a puck engaging surface on opposite sides of a line extending along a width or height of the blade member 14. In particular, a protrusion surface 84 generally faces the heel end 16 of the hockey stick blade, while a surface 86 generally faces the toe end 18 of the hockey stick blade 10. The location of the protrusion 80 on the blade member 14 can be approximately at a midpoint between the ends 16 and 18. Although illustrated where the protrusion 80 is joined to the backhand puck engaging surface 22 approximately at a midpoint of the blade member 14, this should not be considered limiting in that it could be joined anywhere along the length of the blade member 14, although in a preferred embodiment, the protrusion 80 is joined to the backhand puck engaging surface 22 within the range of about 25% to about 75% of a length of the blade member 14 as measured by the length of a lower edge 55 of the blade member 14 in contact with a flat surface.

The protrusion 80 can extend along the entire width or height of the blade member 14, or as illustrated, extend only along a portion thereof, herein advantageously placed on a lower portion of the puck engaging surface 22 since commonly this is where the puck 36 generally will be present. By only providing the protrusion 80 along a portion of the hockey stick blade 10, the mass of the hockey stick blade 10 is minimized.

In the embodiment illustrated, the protrusion 80 is formed so as to provide a lower edge 88 that extends upwardly and away from a lower edge of the blade member 14 in a manner similar to that of edge 66 of the extension 24 so as to again allow the blade member 14 to be tilted rearwardly, if desired. In this embodiment, all surfaces of the protrusion 80 blend smoothly with the backhand puck-engaging surface 22; however, if desired, sharper edges formed between the protrusion 80 and the puck-engaging surface 22 can be provided.

As indicated above, FIGS. 6-10 illustrate a hockey stick blade 10' that may be preferable for use by a goalie. The hockey stick blade 10' has a longitudinal length between a heel 16 and the toe end 18 that is longer than that of the hockey stick blade 10. Likewise, the hockey stick blade 10' is typically wider or taller when placed on the ice than the hockey stick blade 10. The same references numbers have been provided in FIGS. 6-10 to identify similar components between the hockey stick blade 10 and the hockey stick blade 10'.

FIGS. 11-15 illustrate a hockey stick blade 10" having a L-shaped structure 28" different than the L-shaped structure 28 described above. Otherwise, the same references numbers have been provided in FIGS. 11-15 to identify similar components between the hockey stick blade 10 and the hockey stick blade 10". The L-shaped structure 28' is different than the L-shaped structure 28 in that the L-shaped structure 28" includes an extension 24" and an end portion 26" that has a descending upper edge 24A from the end portion 26" along the length of the extension 24" to the remote end 61" that is significantly less in height than the width of the center portion 32. The smaller remote end 61" may be advantageous in forming a hook to grab a puck from an opponent. In one embodiment, a width (height) of the remote edge of the end 61" of the extension 24" is 30% to 70% of the width (height) of the blade member 14 at the center portion 32, the width being generally perpendicular to both a longitudinal length of the extension 24" and a direction corresponding to the thickness of the extension 24". In one embodiment, the remote end 61" is not centered relative to the width of the center portion 32 but where a lower corner 61A of the remote end 61" is closer to lower edge 55 than an upper corner 61B is to the upper edge 51. In this embodiment, a reinforcing member 70 is provided below the upper edge 24A and above the lower edge 55.

The hockey stick blade 10'" illustrated in FIGS. 16-20 includes a toe that can be considered as having a first L-shaped structure 28'" with a rearwardly extending extension 24'" from end portion 26'" and a second L-shaped structure 72 with a forwardly extending extension 74 from end portion 26'". In the embodiment illustrated, the extending portion 26'", the rearwardly extending extension 24'" and forwardly extending extension 74 are integrally connected together from a single unitary body, where the first L-shaped structure 28'" and the second L-shaped structure 72 form a T-shaped structure. In the embodiment illustrated, each of the extensions 24'" and 74 each has a descending upper edge 76, 78 respectively from the end portion 26'" along the length of the extensions 24'", 74 to remote ends 61'", 81 that each significantly less in height than the width of the center portion 32. Although illustrated where the extensions 24'" and 74 with remote ends 61'" and 81, respectively, are substantially the same but mirror images of each other, this should not be considered limiting. If desired, the extensions 24'" and 74 may be of different lengths or shapes. For instance, the width (height) of the remote ends 61'" and 81 can be of different length. It should also be noted that the upper edges 76, 78 in the embodiment of FIGS. 16-20 or any of the other embodiments need not start at the upper edge of the blade member 14, but rather can start at any desired point along the vertical length of the toe of the blade member 14. This is illustrated by dashed lines 76' and 78', where dashed line 76' is substantially orthogonal to the toe of the blade member 14. Similarly, lower edges 84 and 86 do not need to start at or near the lower edge of the toe of the blade member, but could start from a position above it. It should also be noted that in the illustrated embodiment the blade member 14'" is substantially straight from the heel to the toe of the blade 10'" (rather than being curved realizing concave and convex surfaces as described above) but this should not be considered limiting in that if desired the blade member 14 on blade 10''' can also be curved realizing concave and convex surfaces as described above. Although the present invention has been described with reference to preferred embodiments, workers skilled in the art will recognize that changes may be made in form and detail without departing from the spirit and scope of the invention.

FIGS. 21-25 illustrate an embodiment of a hockey stick 10'''' having another form of a protrusion 80' on the backhand surface on the backhand puck-engaging surface 22. In this embodiment, the protrusion 80 is in the form of a smaller blade (herein also referred to as "backhand blade member") that has a heel end 100 connected to the backhand puck-engaging surface 22 extending outwardly from the backhand puck engaging surface 22 and in generally the same direction as blade member 14 to provide a toe end 102 that is free from the backhand puck engaging surface. The backhand blade member 80' can be straight from the heel end 100 to the toe end 102, or a concave shape as viewed from the back of the blade member 14. The concave shape can have a curve or radius that is greater than that of a puck, approximately the same or less than that of a puck such that the backhand blade member 80'.

Figure 23:
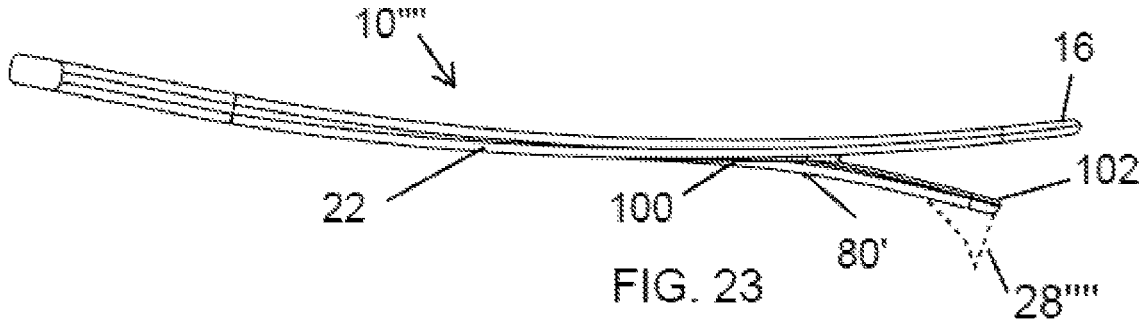
FIG. 23 is a top plan view of the hockey stick blade of FIG. 21.
Figure 24:
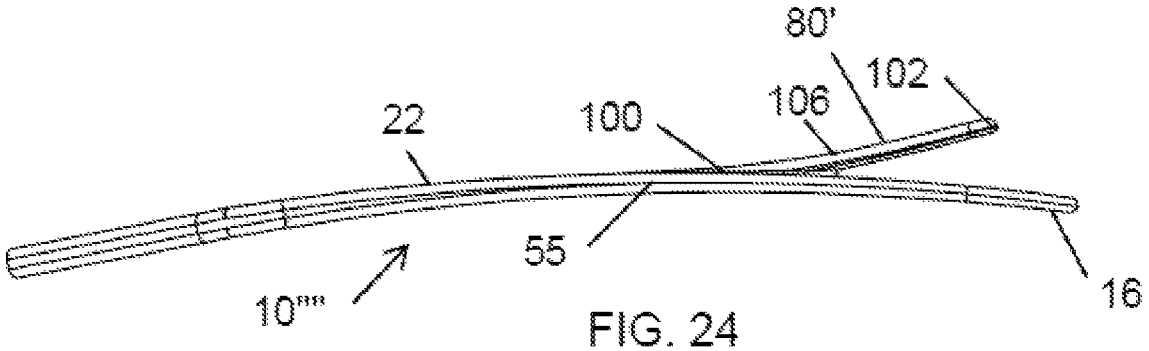
FIG. 24 is a bottom plan view of the hockey stick blade of FIG. 21.
Figure 25:
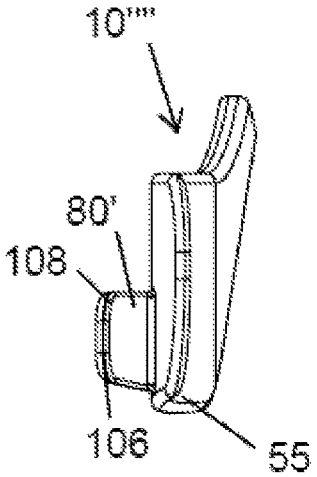
FIG. 25 is a side elevational view of a toe end of the hockey stick blade.

FIG. 23 schematically illustrates that L-shaped structure 28'''' on the end of the backhand blade member 80', if desired. L-shaped structure 28'''' can be of the form of any of the previously described L-shaped structures 28, 28', 28'' or 28''', incorporating all or just some of the features present in the L-shaped structures 28, 28', 28'' or 28'''. When integrated in the backhand blade member 80', the size of the features found in dimensions in the L-shaped structures 28, 28', 28'' or 28''' may be smaller, particularly, in some instances, those related to the height of the L-shaped structures 28, 28', 28'' or 28'''. In one embodiment, L-shaped structure 28'''' is configured like, for example, L-shaped structure 28 such that the cylindrical perimeter surface 38 of the puck 36 contacts the backhand blade member 80' at two spaced apart locations for the advantageous reasons discussed above.

Although illustrated where the heel end 100 is joined to the backhand puck engaging surface 22 approximately at a midpoint of the blade member 14, this should not be considered limiting in that it could be joined anywhere along the length of the blade member, although in a preferred embodiment, the heel end 100 is joined to the backhand puck engaging surface 22 within the range of about 25% to about 75% of a length of the blade member 14 as measured by the length of a lower edge 55 of the blade member 14 in contact with a flat surface. The heel end 100 can be a separate element joined to the backhand puck engaging surface 22, or formed integrally therewith from a single unitary body.

The length of the backhand blade member 80' preferably does not to exceed or is equal to the end of the toe 16 of the blade member 14. In addition, the height of the blade member 80' preferably does not exceed or is equal to the height of the blade member 14, but rather is shorter than the height of the blade member 14. In a further embodiment, the height of the backhand blade member 80' is approximately equal to the height or thickness of a puck. The backhand blade member 80' can have a lower edge 106 that is elevated from the lower edge 55 so that the lower edge 106 does not strike the ice or floor when the user makes a forehand shot. In that manner, the height of the backhand blade member 80' can be less than a thickness of a puck; however an upper edge 108 of the backhand blade member can be approximately at the height of the puck when flat on the ice or floor.

Although the subject matter has been described in a language specific to structural features and/or methodological acts, it is to be understood that the subject matter defined in the appended claims is not necessarily limited to the specific features or acts described above as has been determined by the courts. Rather, the specific features and acts described above are disclosed as example forms of implementing the claims.

What is claimed is:

1. A hockey stick blade, comprising, a blade member extending in a longitudinal direction from a heel end to a toe end and provided with forehand and backhand puck-engaging surfaces extending between said ends, and an extension joined to the toe end of the blade member and extending away from the toe end of the blade member in a backhand direction, wherein the extension and a portion of the blade member at the toe end joined to the extension form an L-shaped structure, wherein a thickness of the extension is less than or about equal to a thickness of a center portion of the blade member, wherein a lower corner of a remote end is closer to a lower edge of the blade member than an upper corner of the remote end is to the upper edge of the blade member; and wherein a width of the extension decreases in a direction rearwardly from the blade member, the width being generally perpendicular to a longitudinal length of the extension and a direction corresponding to the thickness of the extension.

2. The hockey stick blade of claim 1 wherein the L-shaped structure is configured so that a cylindrical perimeter surface of a puck engages the backhand puck-engaging surface and the extension at two spaced apart locations.

3. The hockey stick blade of claim 2 wherein contact at each of the spaced apart locations is along a line.

4. The hockey stick blade of claim 1 wherein a surface of the extension facing away from heel end of the blade member is substantially planar.

5. The hockey stick blade of claim 4 wherein a lower edge of the extension proximate the blade member is above a lower edge of the blade member proximate the extension.

6. The hockey stick blade of claim 1 and a second extension joined to the extension and extending in a direction opposite the extension.

7. The hockey stick blade of claim 6 wherein the blade member is substantially straight from the heel to the toe.

8. The hockey stick blade of claim 1 wherein a width of a remote edge of the extension is less than a width of the blade member at the center portion, the width being generally perpendicular to a longitudinal length of the extension and a direction corresponding to the thickness of the extension.

9. A hockey stick blade, comprising, a blade member extending in a longitudinal direction from a heel end to a toe end and provided with forehand and backhand puck-engaging surfaces extending between said ends, and an extension joined to the toe end of the blade member and extending away from the toe end of the blade member in a backhand direction, wherein the extension and a portion of the blade member at the toe end joined to the extension form an L-shaped structure, wherein a thickness of the extension is less than or about equal to a thickness of a center portion of the blade member, wherein an upper edge of the extension descends along the length of the extension rearwardly to a remote end.

10. The hockey stick blade of claim 9 wherein a lower corner of the remote end is closer to lower edge of the blade member than an upper corner of the remote end is to the upper edge of the blade member.

11. A hockey stick blade, comprising, a blade member extending in a longitudinal direction from a heel end to a toe end and provided with forehand and backhand puck-engaging surfaces extending between said ends, and a protrusion extending away from the backhand puck-engaging surface having four sides, wherein the four sides converge as the four sides extend away from the backhand puck-engaging surface and wherein a side facing the heel is concave, the protrusion being disposed at a location on the backhand puck-engaging surface within a range of about 25% to about 75% of a length of the blade member as measured by a length of a lower edge of the blade member in contact with a flat surface between the toe end and the heel end of the blade member, and wherein the backhand puck-engaging surface from the protrusion to the heel end of the blade member is smooth allowing a puck to slide along the backhand puck-engaging surface from the heel end to the protrusion wherein the protrusion inhibits further sliding along the backhand puck-engaging surface to the toe end by contact of the puck with the concave side facing the heel.

12. The hockey stick blade of claim 11 wherein the forehand puck-engaging surface is concave.

13. The hockey stick blade of claim 2 wherein the backhand puck-engaging surface is convex.

14. The hockey stick blade of claim 11 wherein the protrusion is disposed approximately at a midpoint along a length of the blade member between the ends.

15. The hockey stock blade of claim 11 wherein the protrusion is disposed closer to one of the ends than the other.

16. The hockey stick blade of claim 11 wherein a width of a protrusion is less than the blade member, the width being generally perpendicular to a longitudinal length of the blade member and a direction away from the backhand puck engaging surface.

17. The hockey stick blade of claim 11 wherein the protrusion comprises a blade member of height less than a height of the blade member.

18. The hockey stick blade of claim 11 wherein a lower edge of the protrusion extends upwardly and away from a lower edge of the blade member.

19. The hockey stick blade of claim 11 wherein a surface of the protrusion facing the toe end blends with the backhand puck-engaging surface.

* * * * *